US005690478A

United States Patent [19]

Zöllner

[11] Patent Number: 5,690,478

[45] Date of Patent: Nov. 25, 1997

[54] SOLID MATERIAL PUMP

[75] Inventor: Peter Zöllner, Glinde, Germany

[73] Assignee: Abel GmbH & Co., Buchen, Germany

[21] Appl. No.: 574,941

[22] Filed: Dec. 19, 1995

[30] Foreign Application Priority Data

Dec. 30, 1994 [DE] Germany ..... 44 47 209.9

[51] Int. Cl.[6] ..... F04B 15/02; F04B 53/10

[52] U.S. Cl. ..... 417/533; 417/900; 417/539

[58] Field of Search ..... 417/533, 538, 417/539, 900

[56] References Cited

U.S. PATENT DOCUMENTS

| | | | |
|---|---|---|---|
| 3,109,378 | 11/1963 | Baines | 417/539 |
| 3,667,869 | 6/1972 | Schlecht | 417/533 X |
| 4,744,735 | 5/1988 | Niemand | 417/533 |
| 4,893,992 | 1/1990 | Schlecht | 417/900 X |
| 5,257,912 | 11/1993 | Oakley | 417/900 X |
| 5,336,052 | 8/1994 | Zöllner et al. | 417/900 X |
| 5,388,965 | 2/1995 | Fehn | 417/900 X |

FOREIGN PATENT DOCUMENTS

| | | |
|---|---|---|
| 0 567 826 A2 | 11/1993 | European Pat. Off. . |
| 485 470 | 3/1931 | Germany . |
| 8223016 U | 11/1982 | Germany . |
| 36 35 723 A1 | 4/1987 | Germany . |
| 42 14 109 C2 | 11/1993 | Germany . |

*Primary Examiner*—Richard E. Gluck

*Attorney, Agent, or Firm*—Vidas, Arrett & Steinkraus, P.A.

[57] ABSTRACT

A solid material pump comprising a pump housing, a pair of parallel pump cylinders driven by hydraulic cylinders and each connected to a pump chamber, a slurry feed device which communicates via inlet valves with inlet valve chambers each of which communicates with a pump chamber, the axes of valve cylinders for actuating the inlet valves extending in parallel and spaced relationship to the axes of the pump cylinders and the inlet openings being provided at the pump housing opposite to the pump cylinder whereby the sucked-in flow is deflected twice, further comprising outlet valve chambers adapted to communicate via outlet valves each with a pump chamber and connected to a common outlet conduit, with the valve cylinders for actuating the outlet valves being connected to the pump housing on the side opposite to the inlet valve cylinders and their axes extending in parallel and spaced relationship to the axes of the pump cylinders and the inlet valve cylinders. The axes of the inlet cylinders and the pump cylinders are so close to each other and the pump chamber, the inlet valve chamber and the junction zone are formed so and merge into each other such that the sucked-in flow is deflected no more than within an angular range of 45° or less with respect to the axes of one of the valve cylinders and of the pump cylinders, respectively.

10 Claims, 7 Drawing Sheets

SOLID MATERIAL PUMP

FIELD OF THE INVENTION

The invention relates to a solid material pump.

Solid material pumps which operate by means of a pair of parallel pump cylinders which alternatively take in and discharge the slurry and which are actuated by hydraulic cylinders are generally known and are extensively used. The two inlet openings of the pump housing and, respectively, the inlet valves have associated therewith inlet valve cylinders which alternatively open and close to allow to take in the slurry which is fed, if desired, by a suitable feed device. The outlet openings of the pump housing and, respectively, the outlet valves have associated therewith also a pair of outlet valve cylinders which alternatively open and close in order to discharge the slurry via a common outlet conduit.

BACKGROUND OF THE INVENTION

In a known solid material pump of this type, it has become known to arrange the inlet and outlet valves perpendicularly to the axes of the pump cylinders. As a result the slurry is deflected for 90° during the suction stroke. When a feed device such as a double shaft feed screw is used for feeding, a substantial amount of energy is required to provide for optimal loading of the pump cylinders. A further drawback is that the valve rods of the suction valves subdivide the outlet passage of the pump housing. As a result, the conveyance of slurries comprising substantial solid material particles such as stones or the like is restricted.

Furthermore it has become known to arrange the inlet and, respectively, outlet valve cylinders not perpendicularly but oppositely paraliel and parallel to the pump cylinders.

Since the outlet valves and the pump cylinders are approximately in one plane, the inlet valves are to be arranged such that the pressed-in slurry is deflected twice for 90° with respect to the pump cylinder.

The problem to be solved by the invention is to improve a solid material pump of the above-defined type such that the flow within the pump housing is deflected as little as possible when the slurry is taken in.

This problem is solved by the features of the present invention.

SUMMARY OF THE INVENTION

In the solid material pump of the invention the axes of the inlet valve cylinders and the pump cylinders are so close and the pump chamber, the inlet valve chamber and the associated junction zone are formed so and merge to each other such that the sucked-in flow is not deflected for more than an angular range of about 45° and less. In order to obtain this only slight deflection, it is desired that the inlet valve chamber is of dimensions such as to provide for a relatively great flow cross-section of the transition to the pump chamber proper which is opposite to the respective pump cylinder. A further pre-requisite is that the outlet valve chamber and, respectively, the outlet valve are not on the same level as the pump cylinder but are also offset with respect thereto. According to a development of the invention this offset is such that the axis of the pump cylinder is still outside of the outlet valve opening. As a result the outward flow also needs to be deflected. Such deflection, however, is relatively uncritical because it is possible to generate sufficient pressure by means of the pump cylinder and, respectively, its corresponding drive in order to provide for proper outflow of the slurry.

The feed device, for example a double shaft screw, can be disposed either in the upper or in the lower area of the solid material pump depending on the operative requirements. If it is disposed below, it can be disposed directly on the ground which my be of advantage in certain applications where a small height of the screw inlet flange is required. According to a development of the invention, the valve seats for the inlet and outlet valves are arranged to be removable and are mounted preferably by threaded means. The valve seat is preferably formed by a ring which is mounted by threaded means, by means of a suitable valve seat plate.

With the above described development of the invention, all axes of the pump and valves cylinders are parallel. In an alternative embodiment of the invention the parallel axes of the inlet valve cylinders and outlet valve cylinders extend under an angle to the axes of the pump cylinders. As a result the sucked-in flow to the pump cylinder is deflected threetimes, with the deflection angles being relatively small. On the other hand a relatively great deflection for the discharged slurry results, while the angular range of the deflection is still limited.

To arrange the inlet and outlet cylinders under an angle is known per se. In the known pump the respective valve seats are situated in the respective conduit portions. The inlet flow of the known pump is also deflected for 90° while the outlet flow is not deflected.

A third embodiment of the invention provides that the axes of the inlet valve cylinder extend under an accute angle, with their intersection being in the area of the feed device. The outlet valve cylinders are arranged in the same manner as in the above described embodiment of the invention. When in the third embodiment a double shaft screw is used for feeding, then the intersection of the two axes of the inlet valve cylinders is situated substantially along a line between the two screw shafts. The pump cylinders and the screw shaft conveyors extend approximately along the same axis; however, the slurry when conveyed in the pump cylinders via the inlet valve chamber undergoes a deflection the maximal angle of which is again limited and is substantially less than 60°, preferably less than 45°.

BRIEF DESCRIPTION OF THE DRAWINGS

The invention will be explained in more detail in the following with reference to drawings.

DETAILED DESCRIPTION OF THE INVENTION

Figure 1:
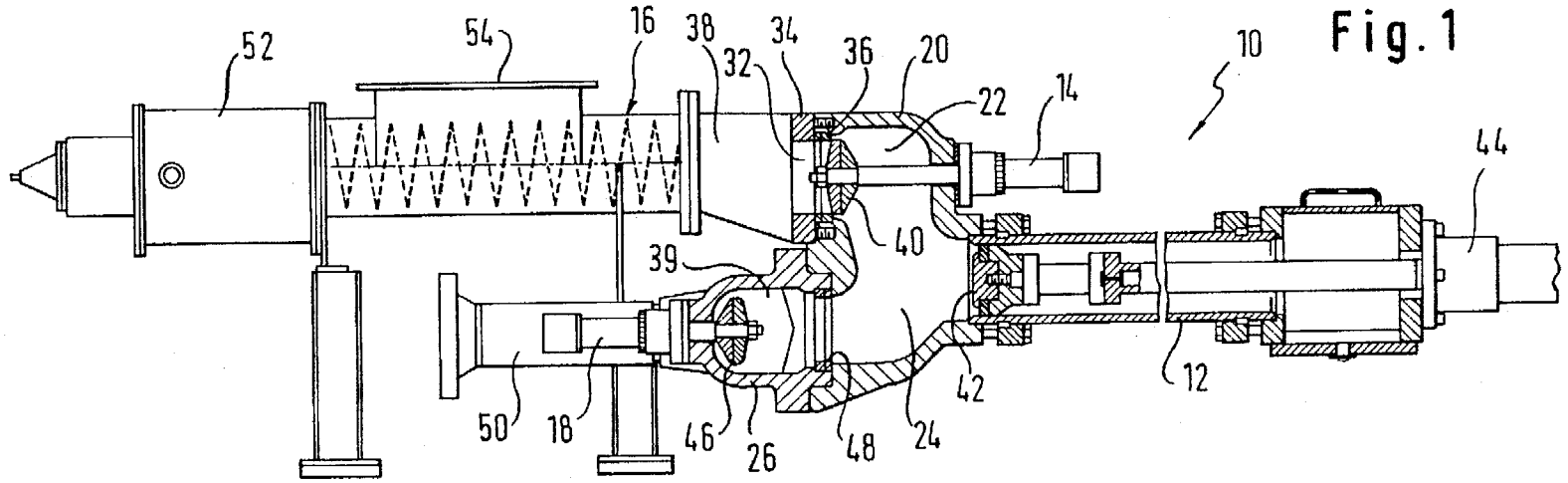
FIG. 1 shows a section of a first embodiment of a pump of the invention during a discharge operation.

FIGS. 1 to 4 show a solid material pump 10 of which, however, only a pump cylinder 12, an inlet valve cylinder, a screw conveyor 16 and an outlet valve cylinder 18 have been shown. The cited components are connected to a pump housing 20 which includes an inlet valve chamber 22 and a pump chamber 24. It is to be noted that the pump housing 20 is vertically subdivided to provide for a pair of inlet valve chambers and, respectively, pump chambers.

The outlet valve cylinder and the outlet valve are connected to a separate housing section 26.

Figure 2:
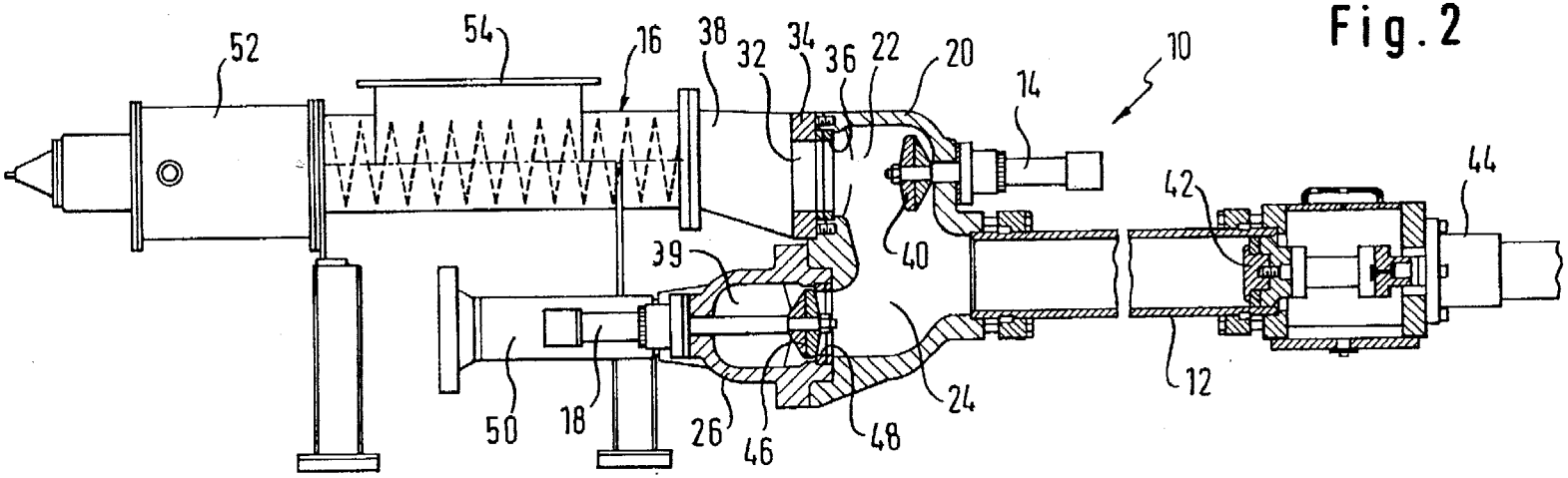
FIG. 2 shows the pump of FIG. 1 during the loading operation.

A suction cylinder 38 is connected between the screw conveyor 16 and an inlet opening 32 defined by a plate 34 by means of which a valve seat ring 36 has been fixed in the pump housing 20, with the plate 34 being bolted to the pump housing 20. The axis of the suction cylinder is somewhat inclined to the opening 32. In FIG. 1 the valve member designated by 40 is shown to be in abutment with the valve seat ring 36, the valve cone being mounted to the piston rod of the inlet valve cylinder 14 by threaded means. The pump piston 42 of the pump cylinder 12 is in its most extended position. It is driven by means of a hydraulic cylinder 44, which has not been shown in more detail. The outlet valve member 46 which is formed and mounted in the same manner is shown in its open position. Accordingly the associated valve seat 39 allows for the slurry exiting from the pump cylinder 12 to pass into the associated outlet valve chamber 39. The outlet valve chambers of both outlet valves are communicated to a common central outlet conduit 50. In the condition shown in FIG. 1 the slurry is discharged from the pump cylinder 12 via the open valve 46 into the conduit 50. At this time the inlet valve 40 is closed. In this condition the screw conveyor 16 cannot feed any slurry into the pump housing 20. The screw conveyor 16 is driven by a suitable drive 52 and is loaded from above at 54 in a manner not shown. FIG. 2 shows an open valve 40 and a closed valve 46. As may be seen the flow generated by the screw conveyor 16 and by movement of the pump piston 42 into the chambers 22 and 24 moves along a slight S-curve so as to be deflected only slightly, in any case for an angle less than 45° with respect to the axes of the valves 14 and, respectively, the pump cylinders 12. As a result flow resistance is relatively small. This is due to the fact that the axes of the valve cylinders 14 which are coaxial to the axes of the intake opening are very close to the axes of the pump cylinders 12. The lowest point of the intake opening 32 is only slightly outside of the upper-most point of the pump cylinder 12. Furthermore, the inlet valve chamber 22 is relatively large as compared to the pump chamber 24 so that the flow between the chambers 22, 24 is inclined under an angle to the above mentioned axes. Due to this relatively slight deflection the required pressure force of the conveyor 54 is relatively small. However, the axes of the outlet valve cylinders 18 are substantially offset with respect to the axes of the pump cylinder 12. In the shown case the uppermost point of the outlet opening is still outside of the axis of the pump cylinder 12 so that the slurry discharged from the pump cylinder flows along a slightly S-shaped curve. A very compact pump providing for optimal flow conditions results.

Figure 3:
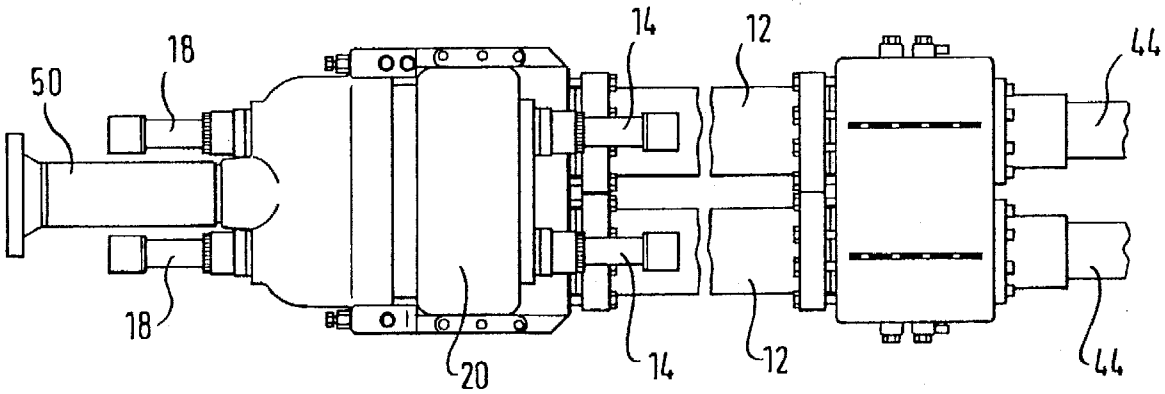
FIG. 3 shows a top view of the pump of FIG. 1.
Figure 4:
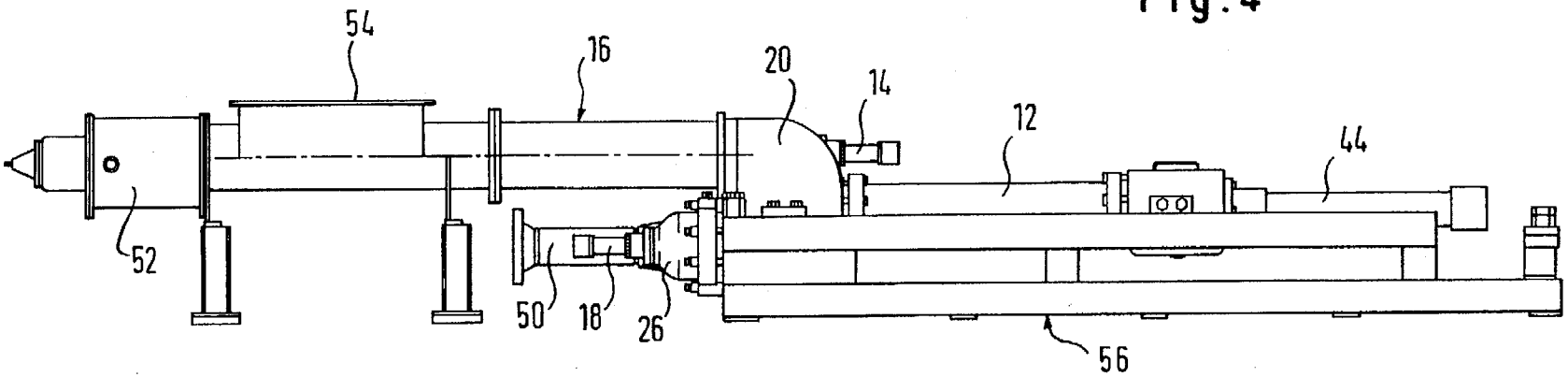
FIG. 4 shows a side elevation of the pump of FIG. 1
Figure 5:
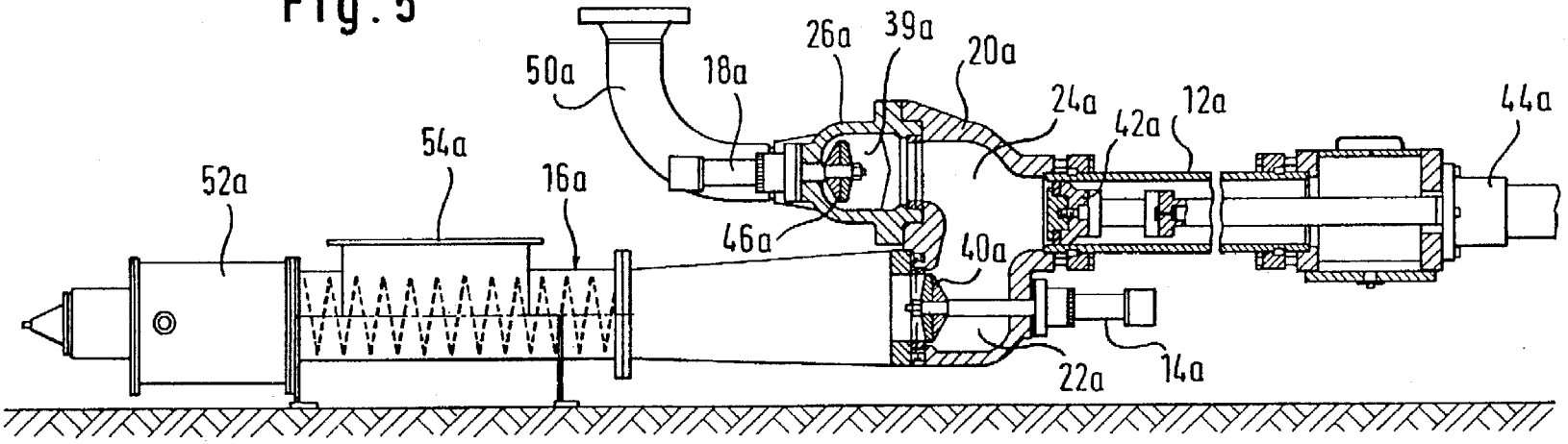
FIG. 5 shows a section of another embodiment of a pump of the invention during the discharge operation.
Figure 6:
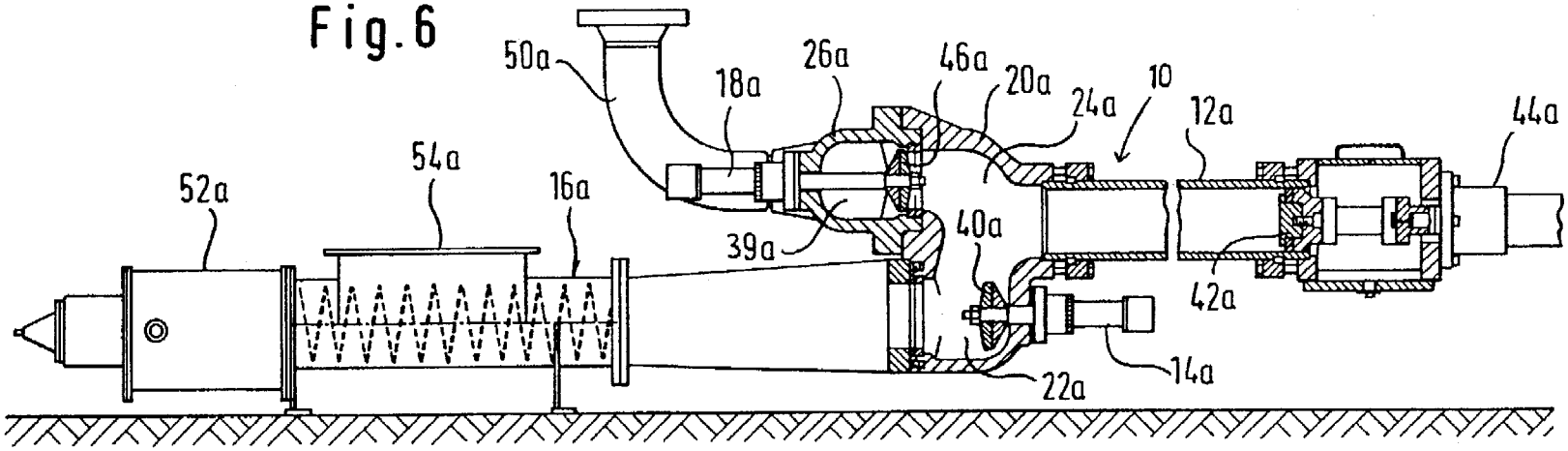
FIG. 6 shows the pump of FIG. 5 during the loading operation.
Figure 7:
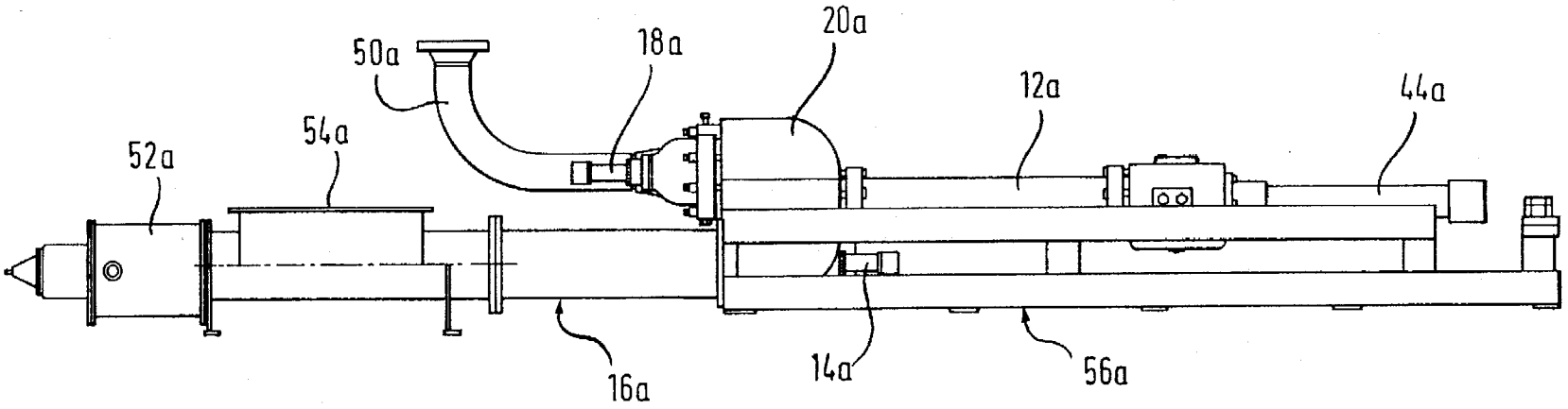
FIG. 7 shows a side elevation of the pump of FIG. 5 or 6.

FIG. 4 shows a side elevation of the pump of FIGS. 1 to 3; as may be seen it is mounted on a frame 58 which stands upon a not shown ground, with the feed conveyor 16 being raised above the ground. In the embodiment of FIGS. 5 to 7 the relationships are reversed. Since, however, similar components as in the embodiment of FIGS. 1 to 4 have been used, also similar reference numerals with the addition of "a" have been used.

In FIGS. 5 to 7 the pump housing **20*a* has been rotated for 180° so that the outlet valve cylinder 18*a* is situated above the pump cylinder 12*a* and the inlet valve cylinders 14*a* are disposed below them. As a result the screw conveyor 16*a* can stand directly upon the ground (see FIGS. 5 and 6) which may be of advantage for many applications. However, there is no difference in operation and in design as compared to the embodiment of FIGS. 1 to 4**.

Figure 8:
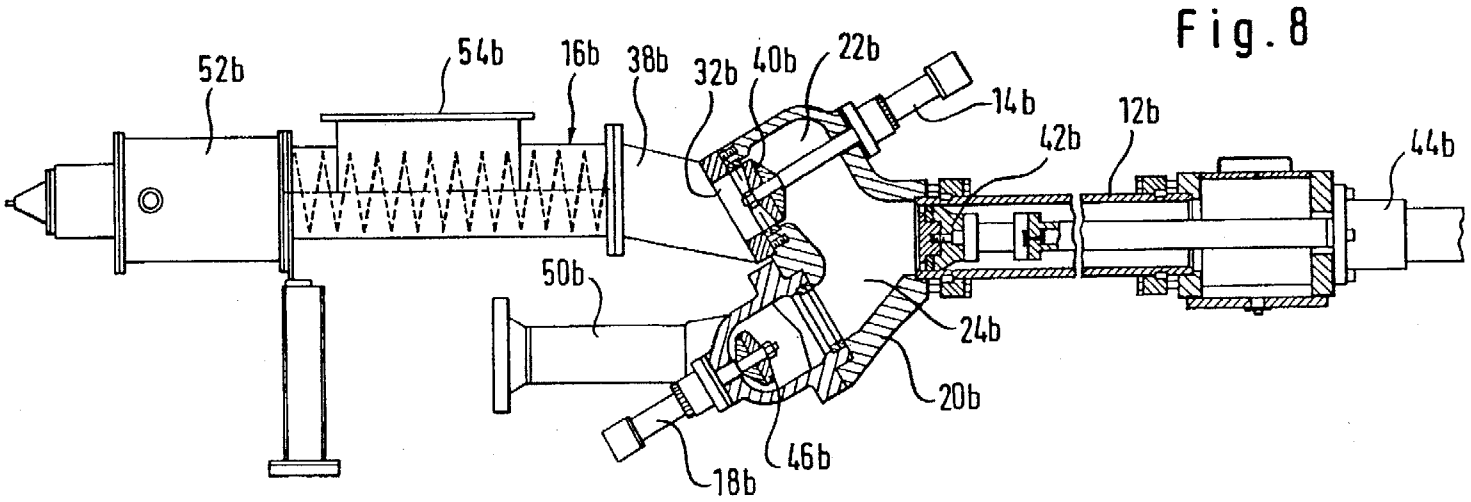
FIG. 8 shows a section of a further embodiment of a pump of the invention during the discharge operation.
Figure 9:
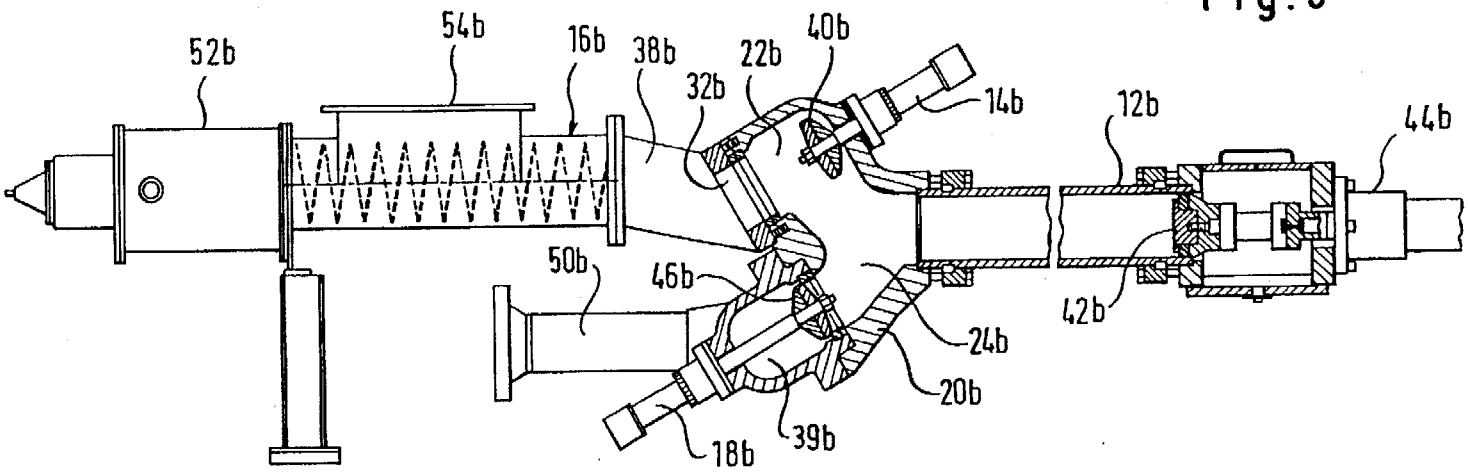
FIG. 9 shows the pump of FIG. 8 during the loading operation.
Figure 10:
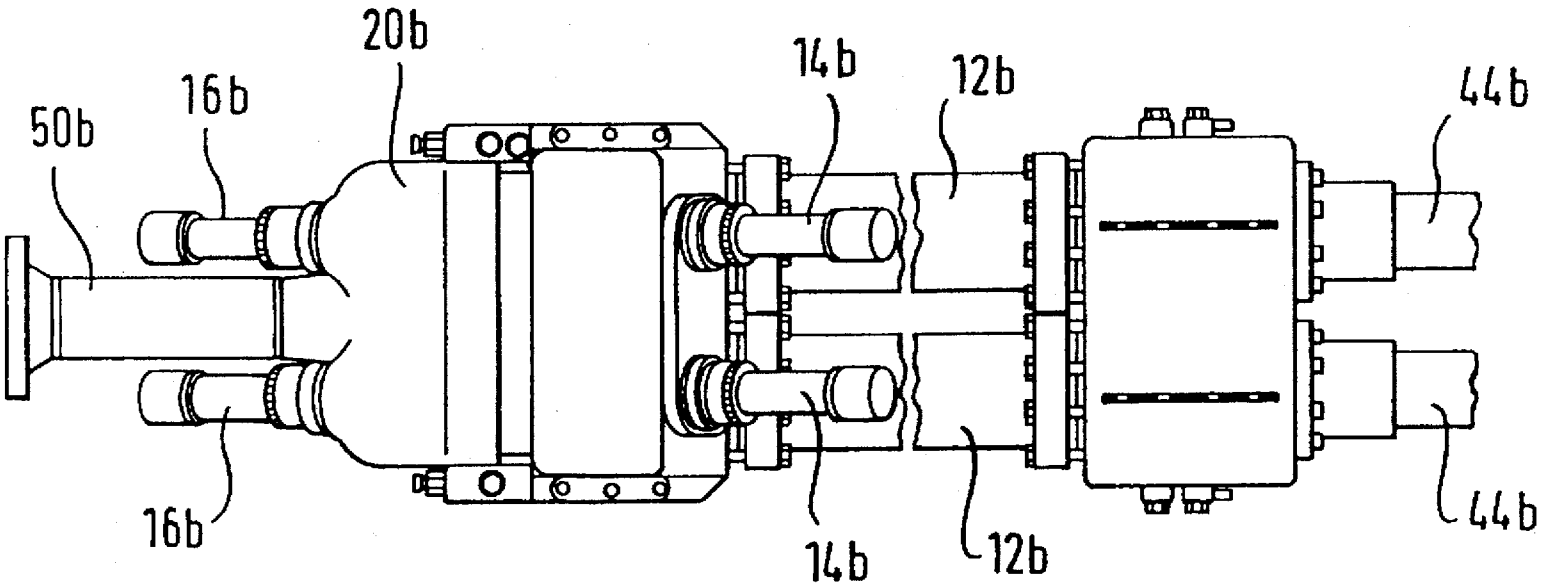
FIG. 10 shows a top view of the pump of FIG. 8 or 9.

In FIGS. 8 to 10 it may be seen that the pump housing **20*b* which is quite similar to that of FIGS. 1 to 3 has been rotated in the plane of the drawing for an angle of about 30° in anti-clockwise direction, with the axes of the valve cylinders 14*b*, 18*b* having been rotated correspondingly. The axes of the pump cylinders 12*b* and the conveyor 16*b*, however, remain in the horizontal. As a result, the suction cylinder 38*a* is inclined a little more. However, the outlet conduit 50*b* is arranged to have a horizontal axis as in FIGS. 1 to 3. FIG. 8 shows, as FIGS. 1 and 2, the displacing of slurry, while FIG. 9 shows the suction operation and the loading of the pump cylinder 12*b*. This is why this operation needs not to be described anymore. As may be seen in FIGS. 8 and 9, flow from the suction cylinder 38*b* to the pump cylinder 12*b*** is deflected threetimes during the suction operation. However, these deflections each are under a relatively small angle so that flow resistance is relatively small.

Figure 11:
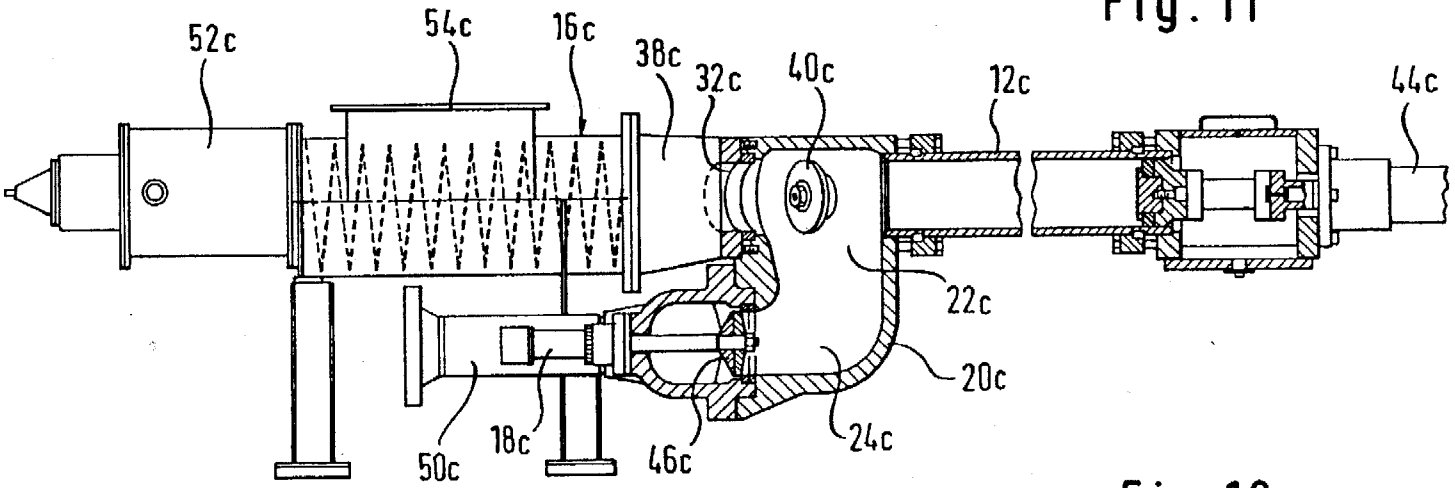
FIG. 11 shows a section of a fourth embodiment of a pump of the invention.
Figure 12:
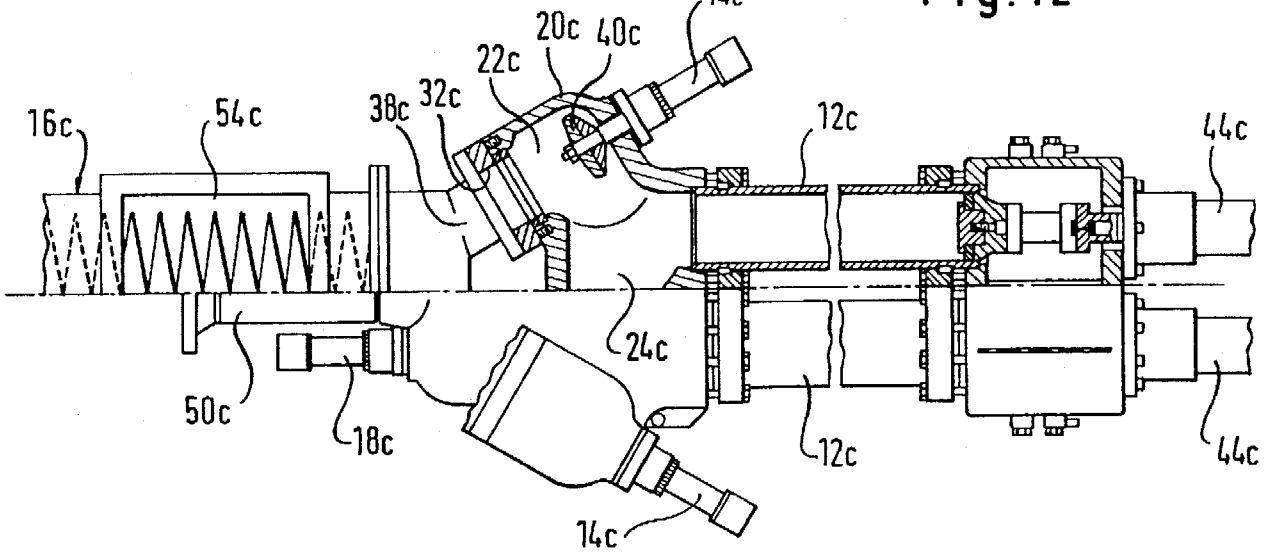
FIG. 12 shows a top view, partially in section, of the pump of FIG. 11.

In the embodiments of FIGS. 11 and 12 the pump cylinder **12*c*, the screw conveyor 16*c* and the outlet valve cylinder 18*c* are arranged in the same manner as in the embodiment of FIGS. 1 to 4. However, the axes of the outlet valve cylinder 18*c* and the screw conveyor 16*c* are closer together. This is due to the fact that the inlet openings 32*c* in the valve housing 20*c* are on the same level as the axes of the pump cylinders 12*c*. In order to enable the provision of a valve assembly for selectively closing the openings 32*c*, the openings have diverging axes as may be seen in FIG. 12. In a similar manner extend the axes of the inlet valve cylinders 14*c* which intersect in a line extending centrally between the screw shafts 16*c*. This is why flow from the suction cylinder 38*c* into the valve housing 22*c* and into the pump housing 24*c* must follow a slight S in order to be able to enter the pump cylinder 12**. Also in this case flow resistance is relatively small.

I claim:

1. A solid material pump comprising a pump housing, a pair of parallel pump cylinders driven by hydraulic cylinders and each connected to a pump chamber, a slurry feed device which communicates via inlet valves with inlet valve chambers each of which are adjacently positioned to and communicates with the pump chambers, wherein the valve chambers and the pump chambers merge into each other to form a junction zone, inlet valve cylinders for actuating the inlet valves, a plurality of inlet openings being provided in the pump housing opposite, yet offset, to the pump cylinders, wherein the pump housing, which forms the inlet valve chambers and the pump chambers, is shaped and configured such that when the material is sucked by the pump cylinder, the material enters the inlet valve chambers via the inlet openings as it flows into the pump cylinder, the solid material pump further comprising outlet valves, outlet valve chambers, each having an outlet opening adapted to communicate via an outlet valve with the pump chambers and connected to a common outlet valve conduit, outlet valve cylinders for actuating the outlet valves, being connected to the pump housing on the side opposite to the inlet valve cylinders, and the axes of the outlet valve cylinders extending in parallel to each other, wherein the axes of the inlet cylinders (14,14*a*) and the pump cylinders (12,12*a*) are arranged and the pump chambers (24,24*a*) and the inlet valve chambers (22,22*a*), are positioned within the pump housing such that the flow of material is sucked in through the inlet openings by the pump cylinder and is diverted within the pump housing at an angle of 45° or less with respect to the axes of one of the valve cylinders (14) and of the pump cylinders (12,12*a*), respectively.

2. A solid material pump according to claim 1, wherein the axes of the valve cylinders for actuating the inlet valves extending in parallel and spaced relationship to the axes of the pump cylinders, the axes of the valve cylinders actuating the outlet valves extending parallel and in spaced relationship to the axes of the pump cylinders and the inlet valve cylinders.

3. A solid material pump according to claim 1, wherein the outlet valve cylinders (18,18*a*) are offset with respect to the pump cylinders (12,12*a*) sufficiently so that a point on the periphery of the outlet opening is substantially aligned with the axis the associated pump cylinder (12,12*a*) and is disposed on the side of the axis of the pump cylinder (12,12*a*) remote from the inlet valve cylinders (14,14*a*).

4. A solid material pump according to claims 2 wherein the pump cylinders (12,12*a*), the inlet valve cylinders (14, 14*a*) and the outlet valve cylinders (18,18*a*) are arranged in parallel horizontal planes.

5. A solid material pump according to claim 4, wherein the inlet valve cylinders (14,14*a*) are disposed above or below the outlet valve cylinders (18,18*a*).

6. A solid material pump according to claims 2 wherein the feed device is a double screw conveyor (16,16*a*).

7. A solid material according to claim 10, further comprising valve seats, wherein the valve seats (36,48,36*a*, 48*a*) are adapted to be removably mounted.

8. A solid material pump according to claim 1, wherein the parallel axes of the inlet valve cylinders (14*b*) and the outlet valve cylinders (18*b*) extend under an angle with respect to those of the pump cylinders (12*b*).

9. A solid material pump according to claim 1, wherein the axes of the inlet valve cylinders (14*c*) extend under an acute angle with respect to each other, with the intersection thereof being in the area of the feed device (16*c*).

10. A solid material pump according to claim 2, wherein the offset between the axes of the inlet valve cylinders (14,14*a*) and the pump cylinders (12,12*a*) is at most 1.5 times the diameter of the pump cylinders (12, 12*a*).

* * * * *

UNITED STATES PATENT AND TRADEMARK OFFICE
CERTIFICATE OF CORRECTION

PATENT NO. : 5,690,478

DATED : Nov. 25, 1997

INVENTOR(S) : Peter Zöllner

It is certified that error appears in the above-identified patent and that said Letters Patent is hereby corrected as shown below:

Col. 1, line 33, delete "paraliel" and insert - parallel --.

Signed and Sealed this

Twenty-fourth Day of February, 1998

*Attest:*

Bruce Lehman

BRUCE LEHMAN

*Attesting Officer*

*Commissioner of Patents and Trademarks*